US009464439B2

(12) United States Patent
Buzza

(10) Patent No.: US 9,464,439 B2
(45) **Date of Patent: *Oct. 11, 2016**

(54) ROOFING SHINGLE SYSTEM AND SHINGLES FOR USE THEREIN

(71) Applicant: Building Materials Investment Corporation, Dallas, TX (US)

(72) Inventor: Stephen A. Buzza, Newburgh, IN (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/527,279

(22) Filed: Oct. 29, 2014

(65) Prior Publication Data

US 2015/0315790 A1 Nov. 5, 2015
US 2016/0145871 A2 May 26, 2016

Related U.S. Application Data

(63) Continuation-in-part of application No. 14/266,294, filed on Apr. 30, 2014, now Pat. No. 9,187,903.

(51) Int. Cl.
*E04D 1/00* (2006.01)
*E04D 1/28* (2006.01)
*E04D 1/12* (2006.01)

(52) U.S. Cl.
CPC . *E04D 1/28* (2013.01); *E04D 1/12* (2013.01); *E04D 2001/005* (2013.01)

(58) Field of Classification Search
CPC ..... E04D 1/20; E04D 2001/005; E04D 1/12; E04D 1/28
USPC ..... 52/311.1, 314, 523, 525, 526, 554, 557, 52/559, DIG. 16; 156/256, 264
See application file for complete search history.

(56) References Cited

U.S. PATENT DOCUMENTS 1,130,368 A * 3/1915 Bird ..... 52/545
1,277,861 A * 9/1918 Clarke ..... 52/559
1,593,096 A 7/1926 Munro
1,894,614 A 1/1933 Wettlaufer
2,060,618 A * 11/1936 Honigbaum ..... 52/526

(Continued)

OTHER PUBLICATIONS

Information Disclosure Statement submitted in U.S. Appl. No. 10/777,590, now U.S. Pat. No. 7,805,905, on May 24, 2010 (7 pages).

(Continued)

*Primary Examiner* — Charles A Fox
*Assistant Examiner* — James Buckle, Jr.
(74) *Attorney, Agent, or Firm* — Fitzpatrick, Cella, Harper & Scinto

(57) ABSTRACT

A two-layer laminated roofing shingle is disclosed comprising a posterior layer having an upper portion and a buttlap including a plurality of simulated tabs extending from the posterior upper portion, each simulated tab is connected to at least one adjacent simulated tab by a connecting segment, and an anterior layer having a headlap and a buttlap including one or more anterior tabs extending from the anterior headlap. Also disclosed is a single layer roofing shingle comprising a headlap and a buttlap including a plurality of simulated tabs extending from said headlap, the simulated tabs spaced apart by a plurality of partial slots, and each simulated tab is connected to at least one adjacent simulated tab by a connecting segment. Also disclosed is a roofing system comprising a plurality of courses of the inventive shingles.

20 Claims, 8 Drawing Sheets

(56) References Cited

U.S. PATENT DOCUMENTS

| | | | | |
|---|---|---|---|---|
| 2,538,206 | A * | 1/1951 | Mabie, Sr. et al. | 52/523 |
| 2,801,599 | A | 8/1957 | Bordeaux | |
| 2,863,405 | A | 12/1958 | Leibrook et al. | |
| 3,407,556 | A | 10/1968 | Leibrook | |
| 3,973,369 | A | 8/1976 | Smith | |
| 4,163,351 | A | 8/1979 | Ishikawa | |
| 4,317,853 | A | 3/1982 | Thiis-Evensen | |
| 4,434,589 | A | 3/1984 | Freiborg | |
| 4,499,702 | A | 2/1985 | Turner | |
| 4,541,217 | A | 9/1985 | Stewart | |
| 4,717,614 | A | 1/1988 | Bondoc et al. | |
| 4,729,814 | A | 3/1988 | Jennus et al. | |
| D300,257 | S | 3/1989 | Stahl | |
| 4,869,942 | A | 9/1989 | Jennus et al. | |
| D313,278 | S | 12/1990 | Noone | |
| D313,658 | S | 1/1991 | Noone | |
| 5,102,487 | A | 4/1992 | Lamb | |
| D326,330 | S | 5/1992 | Klein | |
| 5,181,361 | A | 1/1993 | Hannah et al. | |
| 5,195,290 | A | 3/1993 | Hulett | |
| 5,209,802 | A | 5/1993 | Hannah et al. | |
| D336,347 | S | 6/1993 | Hannah et al. | |
| D340,294 | S * | 10/1993 | Hannah et al. | D25/139 |
| D343,911 | S | 2/1994 | Hulett | |
| 5,287,669 | A | 2/1994 | Hannah et al. | |
| D347,900 | S | 6/1994 | Stapleton | |
| D350,615 | S | 9/1994 | Klein et al. | |
| 5,347,785 | A | 9/1994 | Terrenzio et al. | |
| 5,375,387 | A | 12/1994 | Davenport | |
| 5,375,491 | A | 12/1994 | Hannah et al. | |
| 5,421,134 | A | 6/1995 | Hannah et al. | |
| 5,426,902 | A | 6/1995 | Stahl et al. | |
| D366,124 | S | 1/1996 | Hannah et al. | |
| D366,335 | S | 1/1996 | Noone et al. | |
| 5,488,807 | A | 2/1996 | Terrenzio et al. | |
| D375,563 | S | 11/1996 | Hannah et al. | |
| D376,660 | S | 12/1996 | Hannah et al. | |
| 5,660,014 | A | 8/1997 | Stahl et al. | |
| D388,195 | S | 12/1997 | Hannah et al. | |
| 5,853,858 | A | 12/1998 | Bondoc | |
| 5,901,517 | A | 5/1999 | Stahl et al. | |
| 6,014,847 | A | 1/2000 | Phillips | |
| 6,038,827 | A | 3/2000 | Sieling | |
| D422,719 | S | 4/2000 | Belt et al. | |
| D426,002 | S | 5/2000 | Bondoc et al. | |
| 6,058,670 | A * | 5/2000 | Sieling et al. | 52/554 |
| 6,092,345 | A | 7/2000 | Kalkanoglu et al. | |
| 6,105,329 | A | 8/2000 | Bondoc et al. | |
| 6,195,951 | B1 | 3/2001 | Stahl et al. | |
| 6,212,843 | B1 | 4/2001 | Kalkanoglu et al. | |
| 6,220,329 | B1 | 4/2001 | King et al. | |
| 6,305,138 | B1 | 10/2001 | Stahl et al. | |
| 6,401,425 | B1 | 6/2002 | Frame | |
| 6,419,780 | B1 | 7/2002 | Queisser | |
| 6,421,976 | B1 | 7/2002 | Elliott et al. | |
| 6,457,290 | B1 | 10/2002 | Elliott | |
| 6,467,235 | B2 | 10/2002 | Kalkanoglu et al. | |
| 6,523,316 | B2 | 2/2003 | Stahl et al. | |
| 6,546,688 | B1 | 4/2003 | Parsons | |
| 6,578,336 | B2 | 6/2003 | Elliott | |
| D482,141 | S | 11/2003 | Rodrigues | |
| D484,992 | S | 1/2004 | Rodrigues | |
| 6,679,020 | B2 | 1/2004 | Becker et al. | |
| 6,708,456 | B2 | 3/2004 | Kiik et al. | |
| 6,715,252 | B2 | 4/2004 | Stahl et al. | |
| D504,962 | S | 5/2005 | Sieling et al. | |
| 6,920,730 | B2 | 7/2005 | Becker et al. | |
| 6,933,037 | B2 | 8/2005 | McCumber et al. | |
| D554,275 | S | 10/2007 | Sieling et al. | |
| 7,510,622 | B2 | 3/2009 | Kalkanoglu et al. | |
| 7,607,275 | B2 | 10/2009 | Elliott et al. | |
| 7,665,261 | B2 * | 2/2010 | Elliott et al. | 52/557 |
| D611,620 | S | 3/2010 | Kalkanoglu et al. | |
| 7,805,905 | B2 | 10/2010 | Rodrigues et al. | |
| D639,463 | S | 6/2011 | Elliot | |
| D641,502 | S | 7/2011 | Elliot | |
| D644,753 | S | 9/2011 | Elliot | |
| D666,745 | S | 9/2012 | Rodrigues et al. | |
| D669,602 | S | 10/2012 | Jenkins | |
| D670,007 | S | 10/2012 | Jenkins | |
| D670,008 | S | 10/2012 | Jenkins | |
| D674,515 | S | 1/2013 | Jenkins | |
| 8,397,460 | B2 * | 3/2013 | Rodrigues et al. | 52/557 |
| D699,867 | S | 2/2014 | Thompson et al. | |
| 9,057,194 | B2 | 6/2015 | Jenkins et al. | |
| 9,140,012 | B1 | 9/2015 | Leitch et al. | |
| 9,187,903 | B1 | 11/2015 | Buzza | |
| D747,501 | S | 1/2016 | Leitch | |
| D750,810 | S | 3/2016 | Buzza | |
| 2002/0062613 | A1 | 5/2002 | Stahl et al. | |
| 2004/0083673 | A1 * | 5/2004 | Kalkanoglu et al. | 52/555 |
| 2007/0017330 | A1 | 1/2007 | Freshwater et al. | |
| 2007/0068108 | A1 | 3/2007 | Kiik et al. | |
| 2009/0151288 | A1 * | 6/2009 | Kalkanoglu et al. | 52/554 |
| 2009/0229210 | A1 * | 9/2009 | Binkley et al. | 52/543 |
| 2010/0170169 | A1 | 7/2010 | Railkar et al. | |
| 2010/0205898 | A1 | 8/2010 | Rodrigues et al. | |
| 2013/0019554 | A1 | 1/2013 | Rodrigues et al. | |
| 2015/0315789 | A1 | 11/2015 | Buzza | |

OTHER PUBLICATIONS

CertainTeed Shingle Applicator's Manual: Presidential Shake and Presidential Shake TL, http://www.certainteed.com/resources/PresidentialShakeTLInstall.pdf (undated).

* cited by examiner

ROOFING SHINGLE SYSTEM AND SHINGLES FOR USE THEREIN

RELATED APPLICATIONS

This application is a continuation-in-part of U.S. Non-Provisional application Ser. No. 14/266,294, filed on Apr. 30, 2014, entitled "Roofing Shingle System and Shingles for Use Therein," which is incorporated herein by reference in its entirety for all purposes within this application.

FIELD OF THE INVENTION

This invention relates to an improved roofing shingle having the bulk and configuration of more expensive roofing shingles and a roofing system that utilizes the shingles. The inventive roofing shingles have the appearance of thicker shingles and have excellent fire resistance and protection against weather, while retaining the substantially reduced cost of conventional asphalt shingles.

BACKGROUND OF THE INVENTION

Roofing products are often divided into three broad groups: shingles, roll roofing, and underlayment. Shingles and roll roofing typically function as outer roof coverings designed to withstand exposure to weather and the elements. Shingles and roll roofing generally contain the same basic components which provide protection and long term wear associated with asphalt roofing products. These components include a base material made from an organic felt or fiberglass mat which serves as a matrix to support the other components and gives the product the required strength to withstand manufacturing, handling, installation and service in the intended environment. An asphalt coating formulated for the particular service application is often applied to the base material to provide the desired long-term ability to resist weathering and to provide stability under the anticipated temperature extremes. An outer layer of mineral granules is also commonly applied to the asphalt coating to form a surface exposed to the weather which shields the asphalt coating from the sun's rays, adds color to the final product and provides fire resistance.

Asphalt shingles are among the most commonly used roofing materials. Such shingles are typically manufactured as single layer strip shingles, laminated shingles having two or more layers, interlocking shingles and large individual shingles in a variety of weights and colors. Such asphalt shingles are also often referred to as composite shingles. Even though asphalt shingles offer significant cost, service life and flammability advantages over slate or wood shingles, slate or wood shingles are still often preferred due to the pleasing aesthetic appearance of a slate or wood shingled roof. An important aesthetic advantage of such slate or wood shingles is their greater thickness as compared to composite shingles. The thickness of slate or wood shingles results in a more pleasing, layered look for the finished roof.

Various composite shingles have been developed to provide an appearance of thickness comparable to slate or wood shingles. Examples of such composite or asphalt shingles are shown in U.S. Pat. No. 7,805,905 entitled Roofing Shingle; U.S. Pat. No. 8,397,460 entitled Roofing Shingle; U.S. Pat. Appl. Publ. No. 2013/0019554 entitled Roofing Shingle; U.S. Pat. Appl. Publ. No. 2010/0205898 entitled Roofing Shingle; U.S. Pat. No. D554,275 entitled Roof Shingle; U.S. Pat. No. D388,195 entitled Shingle; U.S. Pat. No. D366,124 entitled Tab Portion Of A Shingle; U.S. Pat. No. D375,563 entitled Shingle; U.S. Pat. No. D376,660 entitled Shingle; U.S. Pat. No. D336,347 entitled Tab Portion Of A Shingle; U.S. Pat. No. D340,294 entitled Design For A Tab Portion Of A Shingle; U.S. Pat. No. D366,335 entitled Design For A Tab Portion Of A Shingle; U.S. Pat. No. D313,278 entitled Shingle; U.S. Pat. No. 6,105,329 entitled Trilaminate Roofing Shingle; U.S. Pat. No. 6,220,329 entitled Apparatus for Making Laminated Roofing Shingles; and U.S. Pat. No. 5,102,487 entitled Manufacturing Roofing Shingles.

U.S. Pat. Nos. 7,805,905 and 8,397,460, and U.S. Pat. Appl. Publ. Nos. 2013/0019554 and 2010/0205898 describe two-layer composite roofing shingles with a posterior layer having a posterior headlap and a plurality of posterior tabs extending from the posterior headlap; and an anterior layer, positioned on the posterior layer, having an anterior headlap and at least one alignment notch and at least one anterior tab extending from the anterior headlap, where at least one anterior tab is positioned on the plurality of posterior tabs. At least one anterior tab is absent in two-layer embodiments of the inventions described in the above disclosures, such that the shingles have at least one single-layer tab (i.e., a posterior tab without a corresponding anterior tab positioned over said posterior tab). When installed, this presence and absence of an anterior tab on the shingles along with the posterior tabs and optional shadow bands and shadow tips simulate a variable thickness slate surface.

U.S. Pat. No. D554,275 illustrates two-layer composite roofing shingles with a posterior layer having a posterior headlap and a plurality of posterior tabs extending from the posterior headlap and an anterior layer, positioned on the posterior layer, having an anterior headlap and at least one anterior tab extending from the anterior headlap, where each anterior tab is positioned on a corresponding posterior tab and at least one anterior tab is absent, such that the shingles have at least one single-layer tab (i.e., a posterior tab without a corresponding anterior tab positioned over it). Each of the anterior tabs has the same shape and equal breadth that is less than the breadth of the posterior tabs, each of which has the same shape and equal breadth, and the anterior tabs are positioned over the center of a corresponding posterior tab.

U.S. Pat. No. D388,195 illustrates a two-layer shingle with an undivided posterior layer (i.e., without tabs) and an anterior layer having an anterior headlap and a plurality of tabs having crimped corners. The undivided posterior layer has a bottom edge contour that mirrors the bottom edge contour of the anterior tabs. Each of the anterior tabs has the same shape and equal breadth and is separated from adjacent anterior tabs by openings of equal breadth.

U.S. Pat. No. D366,124 illustrates a two-layer tab portion of a shingle with an undivided posterior layer (i.e., without tabs) and an anterior layer having an anterior headlap and a plurality of tabs having crimped corners. The undivided posterior layer has a bottom edge contour that mirrors the bottom edge contour of the anterior tabs. Each of the anterior tabs has the same shape and equal breadth and is separated from adjacent anterior tabs by openings of equal breadth.

U.S. Pat. Nos. D375,563 and D376,660 illustrate three-layer shingles with an undivided posterior layer (i.e., without tabs), a middle layer having a headlap and a plurality of tabs having crimped corners, and an anterior layer comprising two planks positioned over the center of two corresponding middle layer tabs and extending over the middle layer headlap. Each of the shingles illustrated has two middle layer tabs without an anterior layer plank positioned over the middle layer tab.

U.S. Pat. Nos. D336,347 and D340,294 illustrate three-layer tab portions of shingles with an undivided posterior layer (i.e., without tabs), a middle layer having a fractional headlap and a plurality of tabs having crimped corners, and an anterior layer comprising two planks positioned over the center of two corresponding middle layer tabs and extending over the fractional middle layer headlap. Each of the shingles illustrated has two middle layer tabs without an anterior layer plank positioned over said middle layer tab.

U.S. Pat. No. D366,335 illustrates a two-layer tab portion of a shingle with a posterior layer comprising a single posterior tab with crimped corners and an anterior layer comprising a single anterior tab with crimped corners positioned over the center of the posterior tab.

U.S. Pat. No. D313,278 illustrates single-layer shingles with a headlap and four tabs having crimped corners. Adjacent tabs have different lengths and alternating tabs have the same length. Each tab is partially covered with granules of contrasting color values or shading with discrete rectangular outlines.

U.S. Pat. No. 6,105,329 describes three-layer roofing shingles with an anterior layer having a headlap portion and a butt portion comprising a plurality of tabs of a given breadth separated by spaces approximately 0.50 to 1.25 the breadth of an anterior tab; a middle layer with the same number of tabs as the anterior tabs; and an undivided posterior layer (i.e., without tabs). The middle layer tabs have a breadth such that the middle layer tabs partially fill the spaces between the anterior tabs when the anterior layer is positioned over the middle layer. The middle layer tabs have a configuration complementary to, and are the same height as, the anterior tabs, such that a middle layer tab mirrors an adjacent anterior tab when the anterior layer is positioned over the middle layer. Each tab (e.g., anterior layer tab or middle layer tab) is a single layer of roofing material positioned over the undivided posterior layer, except for embodiments having an alignment means in the form a small tab in the anterior layer spaces, in which case, the middle layer tabs are partially covered by the small anterior tab and the middle layer tabs remain positioned over the undivided posterior layer.

U.S. Pat. No. 6,220,329 describes three-layer roofing shingles with an anterior layer and a mid-layer, each having a headlap portion and a butt portion comprising a plurality of tabs of a given breadth separated by spaces, wherein the tabs of the butt portions of the anterior layer and mid-layer are offset from each; and an undivided posterior layer (i.e., without tabs).

U.S. Pat. No. 5,102,487 describes a method of making laminated shingles having a generally rectangular underlay and an overlay with tabs and cutouts, wherein roofing material is cut with a cutting cylinder that has a common factor with the length of the shingle, other than the length of the shingle itself, to create a sufficient number of shingles having a different pattern of tabs and cutouts to ensure a fairly random appearance when the shingles are applied onto the roof.

Various composite shingles have also been developed with slits or slots as part of an interlocking shingle roofing system. Examples of such composite or asphalt shingles are shown in U.S. Pat. No. 2,801,599 entitled Multiple Tab Square Butt Shingle; and U.S. Pat. No. 3,973,369 entitled Roofing Shingle.

U.S. Pat. No. 2,801,599 describes a single-layer tabbed strip roofing shingle with substantially horizontal slots that engage interlocking tabs of subsequently installed courses of shingles. The horizontal slots are not visible when the shingles are installed.

U.S. Pat. No. 3,973,369 describes a two-layered tabbed roofing shingle with diagonal slots cut into a body sheet of the shingle, but not a backing sheet affixed underneath the body sheet, wherein the slots engage with tab corners of subsequently installed courses of shingles. The diagonal slots are not visible when the shingles are installed.

Each of the above-referenced patents and patent applications is incorporated herein by reference for all purposes within this application.

SUMMARY OF THE INVENTION

One embodiment of this invention pertains to a new two-layer asphalt containing roofing shingle having superior weather resistance and an aesthetic appearance, which simulates a variable thickness slate, tile or wood shake roofing surface, and which further employs a novel backer strip to reduce the risk of wind failure.

In accordance with one embodiment of the present invention, a roofing system is provided having a multiplicity of courses of two-layer roofing shingles, wherein each shingle has a posterior layer (also known as a backer strip) and an anterior layer (also known as a facer), wherein the anterior layer of each shingle has a plurality of tabs spaced apart by a plurality of openings and the posterior layer has a plurality of "partial slots" (defined herein as openings cut into the posterior layer that do not extend to any edge of the buttlap), wherein the partial slots separate the posterior "simulated tabs" (defined herein as regions of the buttlap of a shingle or shingle layer that resemble traditional shingle or shingle layer tabs, but are not completely separated from adjacent similar regions at any edge of the buttlap), wherein the simulated tabs are connected to at least one adjacent simulated tab by a "connecting segment" (defined herein as a portion of shingle or shingle layer material disposed between simulated tabs), and wherein the connecting segment may be located at or near the buttlap edge of the shingle or shingle layer. The connecting segments provide rigidity to single-thickness simulated tabs compared to traditional single-thickness tabs of prior art shingles, while the partial slots provide the visual appearance of discrete tabs that help convey the appearance of bulk. The relatively random pattern of the anterior tabs and anterior openings along with the simulated appearance of discrete posterior tabs (achieved by partial slots and simulated tabs) create the illusion of thickness that makes the roofing shingles appear like more expensive roofing materials such as tile, slate, or wood shakes.

The illusion of thickness may be further enhanced by employing granules of contrasting hues on the tabs or employing shade lines, including to the edges or contours of the tabs according to methods known in the art.

Tabbed two-layer prior art asphalt shingles have utilized configurations wherein at least one posterior tab is not covered by an anterior tab to simulate the random appearance and increased thicknesses of more expensive roofing materials, such as slate or wood. See, e.g., U.S. Pat. No. 7,805,905. Such shingles have tabs that are only one layer thick or single-layer tabs (i.e., the posterior tabs that are not covered by an anterior tab). The two-layer roofing shingles disclosed in U.S. Pat. No. 7,805,905 are susceptible to wind failure when the shingles are installed in cold weather. In cold weather conditions, a relatively modest wind may lift a single-thickness tab, which is more flexible and lighter than a more rigid and heavier double thickness tab, prior to it being fully sealed. When this occurs, dust and other contaminants may land underneath the affected tab, causing it to never fully seal. This affected tab is then susceptible to lifting up due to wind, which may cause a chain reaction lifting up adjacent tabs and eventually the entire shingle.

Applicants have addressed this problem with the invention disclosed and claimed herein. In a preferred embodiment, the partial slots (and optionally the connecting segment, when modified as described below) operate to simulate the appearance of traditional, discrete posterior tabs, while the connecting segment provides rigidity to the single-thickness simulated tabs protecting the simulated tabs from lifting up under mild wind conditions prior to the shingles fully sealing. Not being bound by any particular theory, increased rigidity may be imparted to a single-thickness simulated tab because the simulated tab is connected directly or indirectly to a double-thickness (or multi-layer) simulated tab that has increased rigidity and weight due to increased thickness. Alternatively, a simulated tab may have increased rigidity by virtue of being connected to at least one other simulated tab regardless of the thickness of the simulated tabs on the shingle, i.e., the present invention will provide rigidity and increased protection from wind failure even if the entire shingle is only one layer thick. It will be appreciated that the present invention can be used to impart increased structural rigidity, while still maintaining the aesthetic appearance of discrete tabs without the increased weight of additional material that may otherwise be needed to impart such increased structural rigidity, e.g., the basis weight of a single-layer simulated tab compared to the basis weight of a multi-layered discrete tab.

The invention disclosed and claimed herein allows for a reduction in materials necessary to manufacture shingles of the invention compared to prior art shingles. It is well known in the art that the amount of material required to produce a laminated shingle is reduced when the posterior layer (backer strip) has a narrower width than the anterior layer. The minimum width of a backer strip, however, may be limited by a minimum width of surface contact, or common bond, (measured transversely across the composite shingle) between the underside of the anterior headlap and the upper side of the backer strip necessary to properly secure the backer strip to the anterior layer. See, e.g., FIG. 21 (dimension $W_m$). The minimum width of surface contact ($W_m$) for a two-layer laminated shingle may be at least ¼ inches, and preferably is about ⅞ inches. Thus, when reducing the width of the backer strip, the skilled artisan must consider the profile of the lower edge of the anterior headlap to ensure that the desired minimum width of surface contact is not compromised, for example, in the areas where an alignment notch has been cut into the lower edge of the anterior headlap.

In contrast to prior art shingles, e.g., U.S. Pat. No. 7,805,905, the shingles of the invention do not have alignment notches positioned on a lower edge of the anterior headlap. The absence of alignment notches along the lower edge of the anterior headlap allows a narrower backer strip to be affixed to the anterior layer compared to shingles having notches along the lower edge of the anterior headlap. Prior art shingles with alignment notches must employ a backer strip having sufficient width to provide adequate surface contact in the location of the alignment notch peaks, which results in an excess amount of surface contact, i.e., wider than the desired minimum width of surface contact, in the areas where alignment notches are not present.

In a preferred embodiment, a roofing shingle of the present invention is provided comprising a headlap and a buttlap including a plurality of simulated tabs extending from said headlap, the simulated tabs spaced apart by a plurality of partial slots, and the simulated tabs are connected to at least one adjacent simulated tab by a connecting segment.

In another embodiment, the connecting segment is located at or near the lower edge of the buttlap.

In another embodiment, the connecting segment has a height of about 1 inch.

In another embodiment, the minimum width of surface contact between the underside of the anterior headlap and the upper side of the backer strip is about ⅞ inches.

In another embodiment, the simulated tabs are surfaced with a first shade of granules and the connecting segment is surfaced with a second shade of granules that is darker than the first shade of granules.

In a preferred embodiment, a two-layer laminated roofing shingle is provided comprising:

(a) a posterior layer having a posterior upper portion and a posterior buttlap including a plurality of posterior simulated tabs extending from the posterior upper portion, the posterior simulated tabs spaced apart by a plurality of partial slots, and the posterior simulated tabs are connected to at least one adjacent posterior simulated tab by a connecting segment;

(b) an anterior layer having an anterior headlap and an anterior buttlap including one or more anterior tabs extending from the anterior headlap;

wherein the anterior layer is positioned on the posterior layer in a manner such that each anterior tab is positioned on one of the posterior simulated tabs;

wherein the anterior layer is free of alignment notches positioned on a lower edge of the anterior headlap; and wherein at least a portion of the posterior upper portion is positioned under the anterior headlap.

In a preferred embodiment, a two-layer laminated roofing shingle is provided comprising:

(a) a posterior layer having a posterior upper portion and a posterior buttlap including four posterior simulated tabs extending from the posterior upper portion, the posterior simulated tabs spaced apart by a plurality of partial slots, and the posterior simulated tabs are connected to at least one adjacent posterior simulated tab by a connecting segment, and wherein each posterior simulated tab has a posterior simulated tab corner;

(b) an anterior layer having an anterior headlap, one or more anterior tabs extending therefrom;

wherein the anterior layer is positioned on the posterior layer in a manner such that each anterior tab is positioned on one of the posterior simulated tabs; and wherein at least a portion of the posterior upper portion is positioned under the anterior headlap.

In another embodiment, a roofing system is provided comprising a plurality of courses of shingles of the invention, wherein the shingles are installed on a roof deck in overlapping courses.

In another embodiment, a roofing system is provided comprising a plurality of courses of shingles of the invention, wherein the shingles are installed on a roof deck in overlapping courses, wherein first, second, and third adjacent shingles differ from each other based on the position of at least one anterior tab on a posterior simulated tab, and wherein the first adjacent shingle and the fourth adjacent shingle in a course are identical based on the positions of the one or more anterior tabs, so that when installed, a pattern of varying anterior tabs is created based on the locations of the anterior tabs.

In another embodiment, a roofing system is provided comprising a plurality of courses of shingles of the invention, wherein the shingles are installed on a roof deck in overlapping courses, wherein first, second, third, fourth, and fifth adjacent shingles differ from each other based on the position of at least one anterior tab on a posterior simulated tab, and wherein the first adjacent shingle and the sixth adjacent shingle in a course are identical based on the positions of the one or more anterior tabs, so that when installed, a pattern of varying anterior tabs is created based on the locations of the anterior tabs.

In another embodiment, a roofing system is provided comprising a plurality of courses of shingles of the invention, wherein the shingles are installed on a roof deck in overlapping courses, wherein first, second, third, fourth, fifth, sixth, and seventh adjacent shingles differ from each other based on the position of at least one anterior tab on a posterior simulated tab, and wherein the first adjacent shingle and the eighth adjacent shingle in a course are identical based on the positions of the one or more anterior tabs, so that when installed, a pattern of varying anterior tabs is created based on the locations of the anterior tabs.

In another embodiment, a roofing system is provided wherein the anterior headlap of each shingle comprises one anterior tab extending therefrom.

In another embodiment, a roofing system is provided wherein the anterior headlap of each shingle comprises two anterior tabs extending therefrom.

In another embodiment, a roofing system is provided wherein the anterior headlap of each shingle comprises three anterior tabs extending therefrom.

In another embodiment, a roofing shingle is provided wherein:

- the at least one anterior tab further comprises granules having a first shade and the plurality of posterior simulated tabs further comprise granules of a second shade;
- the posterior layer further comprises a shadow band positioned at an interface between the posterior simulated tabs and the posterior upper portion;
- the posterior simulated tabs further comprise a shadow tip positioned on a lower edge of the posterior simulated tabs;
- the shadow tip and shadow band include granules having a third shade that is darker than the first shade of the at least one anterior tab and the second shade of the posterior simulated tabs.

In another embodiment, a roofing shingle is provided wherein the at least one anterior tab has a first breadth and the posterior simulated tabs have a second breadth, and wherein the second breadth is greater than the first breadth.

In another embodiment, a roofing shingle is provided wherein the posterior simulated tabs are separated by partial slots having a breadth of from about ¼ inch to about 1 inch, and preferably about ⅜".

In another embodiment, a roofing shingle is provided wherein each of the at least one anterior tabs is positioned substantially over the center of one of the posterior simulated tabs.

The shingles of the invention are improvements of roofing shingle materials known in the art, wherein the improvements are providing roofing shingles having simulated tabs that are connected to at least one adjacent simulated tab by a connecting segment, which simulate the appearance of traditional, discrete tabs and having improved weather performance over the prior art, especially with respect to resisting wind failure.

DETAILED DESCRIPTION OF THE FIGURES

For a more complete understanding of the present invention, and the advantages thereof, reference is now made to the following descriptions taken in conjunction with the accompanying figures but which are not to be construed as limiting to the scope of the present invention as defined by the appended claims, in which:

FIG. 20 shows a top plan view of an exemplary embodiment of a single-layer roofing shingle of the present invention.

DETAILED DESCRIPTION

Figure 1:
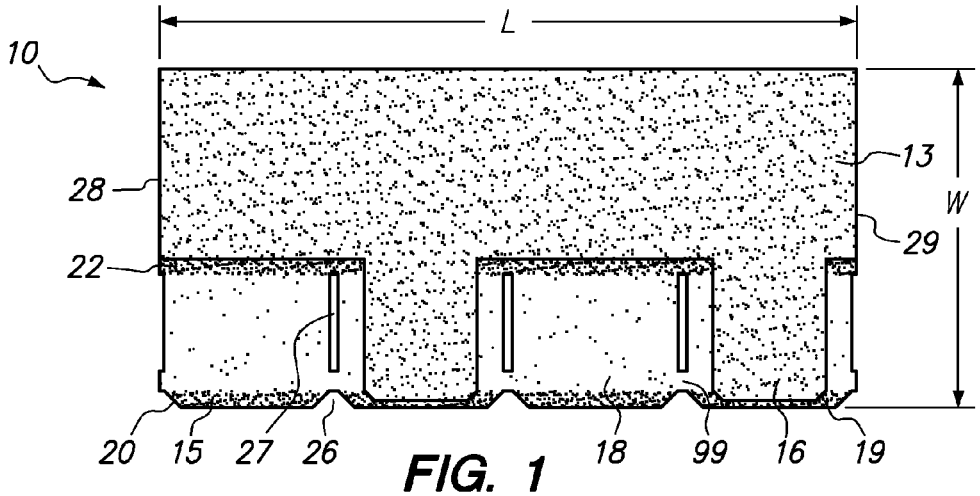
FIG. 1 shows a top plan view of an exemplary embodiment of a two-layer roofing shingle of the present invention.

The preferred embodiments of the present invention and its advantages are best understood by referring to FIGS. 1 through 21, like numerals being used for like and corresponding parts of the various drawings. The different shadings of the individual layers in the drawings are not intended to signify a particular color value or intensity but only to indicate color contrasts between the layers, and each individual layer may be lighter or darker than the shadings indicate; however a color contrast between the layers is optionally employed.

The first embodiment of the present invention, which relates to two-layer composite roofing shingles having the appearance of variable thickness, will now be described in greater detail by referring to the drawings that accompany the present application.

Reference is first made to FIGS. 1, 1A, 1B, 2-13, and 14 illustrating top plan views of the inventive two-layer composite shingle having an anterior layer 11 and a posterior layer 12, wherein the anterior layer 11 is positioned on the posterior layer 12. The anterior layer 11 and posterior layer 12 are each constructed from granular surfaced asphalt coated sheets. In a preferred embodiment, each shingle 10 has a length L of from about 17" to about 52", and preferably about 34½", and a width W of from about 12" to about 19", and preferably about 17".

Figure 1A:
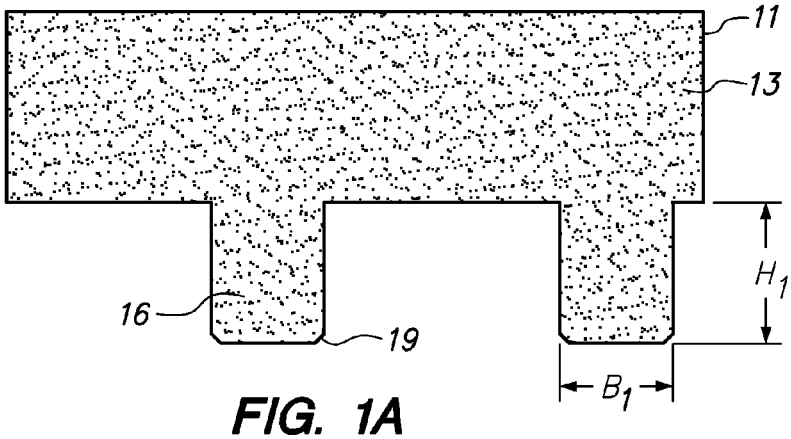
FIG. 1A shows a top plan view of the anterior layer of the shingle of FIG. 1.

Referring to FIG. 1A, the anterior layer 11 comprises an anterior headlap 13 and a buttlap that includes at least one anterior tab 16 extending from the anterior headlap 13. FIGS. 1-6 depict two-layer composite shingles having an anterior layer 11 that includes two anterior tabs 16. FIGS. 7-10 depict two-layer composite shingles having an anterior layer 11 that includes three anterior tabs 16. FIGS. 11-14 depict two-layer composite shingles having an anterior layer 11 that includes one anterior tab 16.

The anterior tabs 16 are surfaced with mineral granules. The butt edges of the anterior tabs 16 can be curved or straight and the anterior tab corners 19 can be cut or can be formed by right, obtuse or acute angles. In a preferred embodiment, the anterior tab corners 19 are cut as depicted in FIGS. 1, 1A, 2-13, and 14.

Referring to FIG. 1A, in another preferred embodiment, the breadth $B_1$ of each anterior tab 16 may be about 40.0% to about 90.0%, and is preferably about 68.2%, the breadth of the posterior simulated tab $B_2$ and the height $H_1$ of each anterior tab 16 may be about 5½" to about 8½", and preferably about 7". In yet another preferred embodiment, referring to FIGS. 1-10, adjacent anterior tabs 16 may be separated by e.g., about 3", about 11⅝", or about 20¼".

The anterior headlap 13 is also surfaced with mineral granules. The anterior layer 11 may be formed by a cutting cylinder having a circumference that is a fraction of the two-layer composite shingle length. The colored mineral granules of the anterior headlap 13 may be the same shade as the anterior tabs 16 or may be different.

Figure 1B:
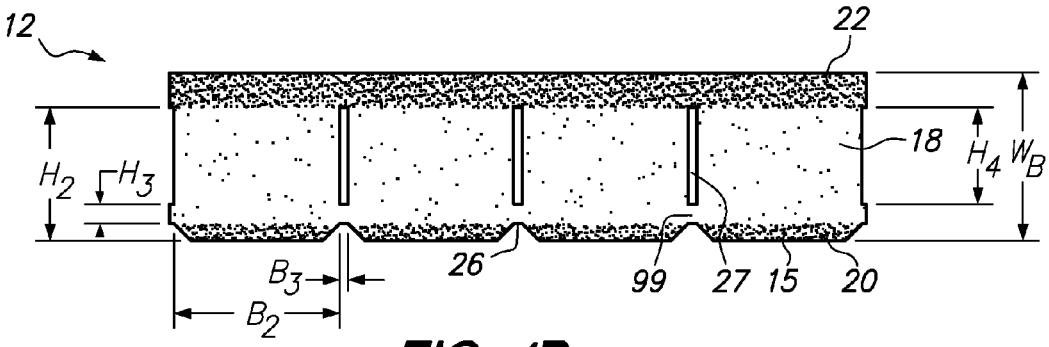
FIG. 1B shows a top plan view of the posterior layer of the shingle of FIG. 1.
Figure 2:
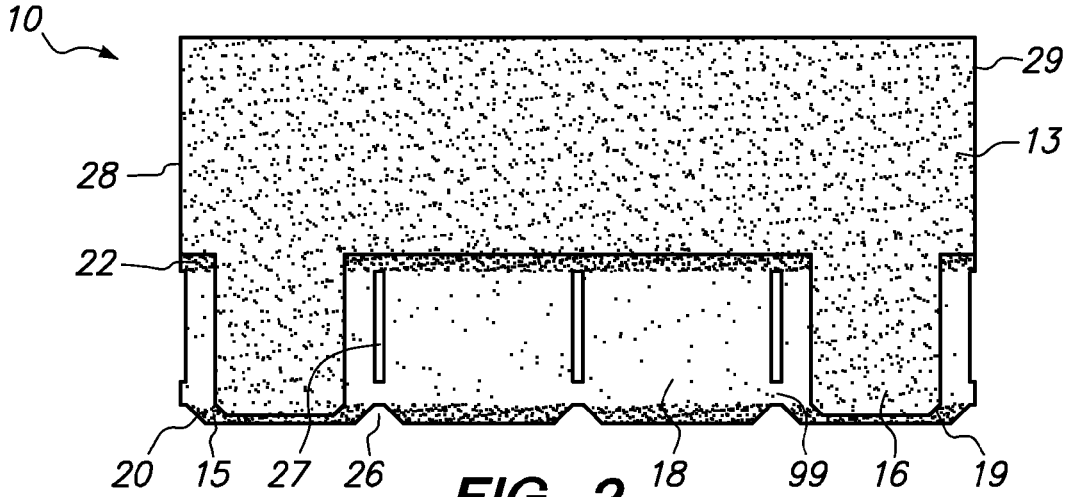
FIGS. 2-14 and 20 show top plan views of various embodiments of the roofing shingle of the present invention.
Figure 3:
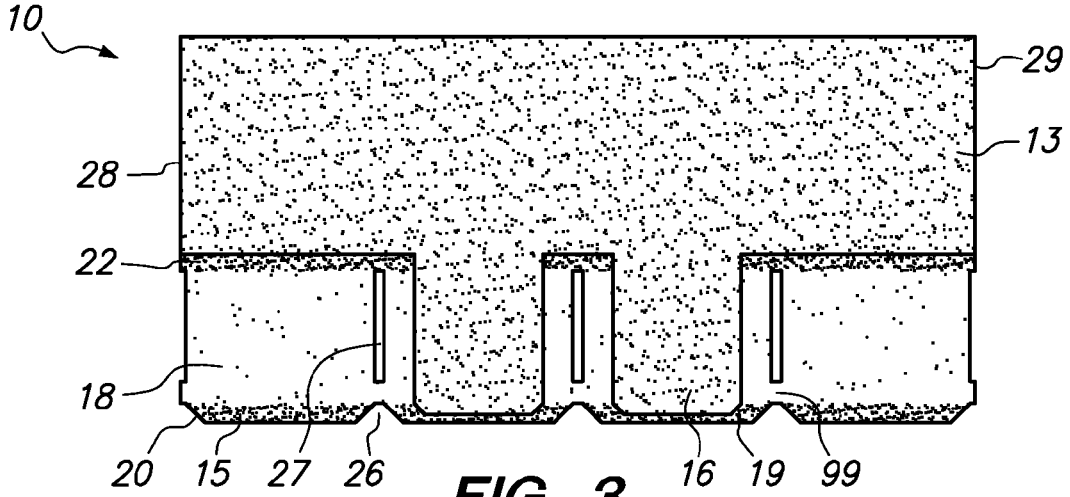
Figure 4:
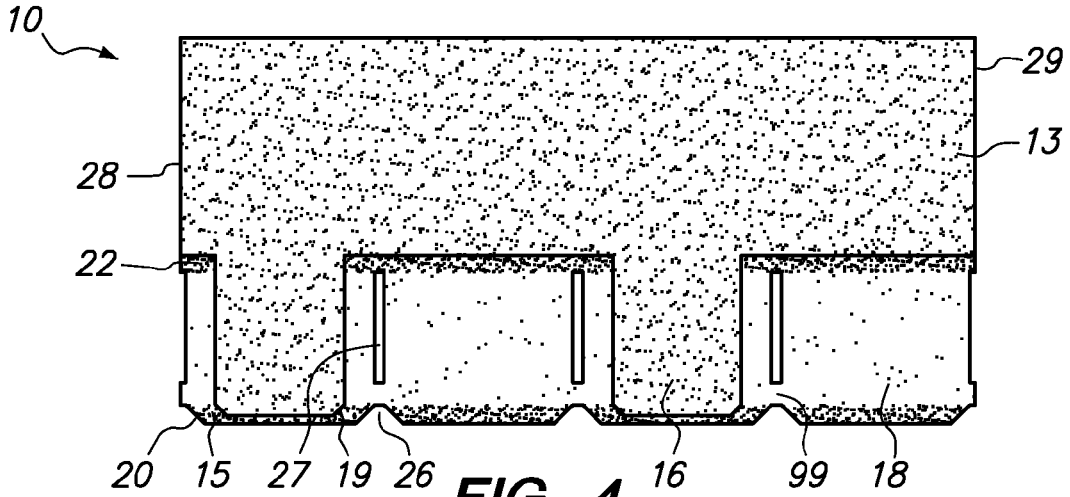
Figure 5:
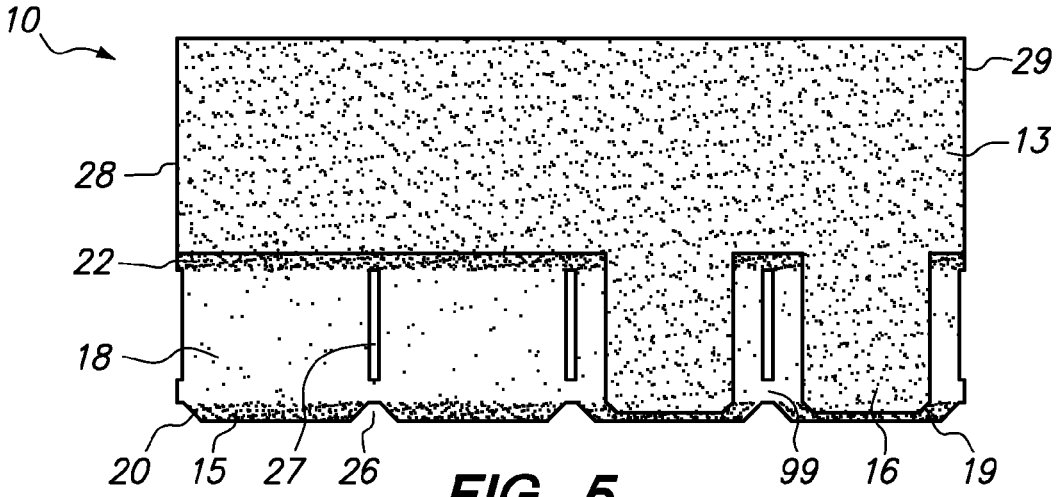
Figure 6:
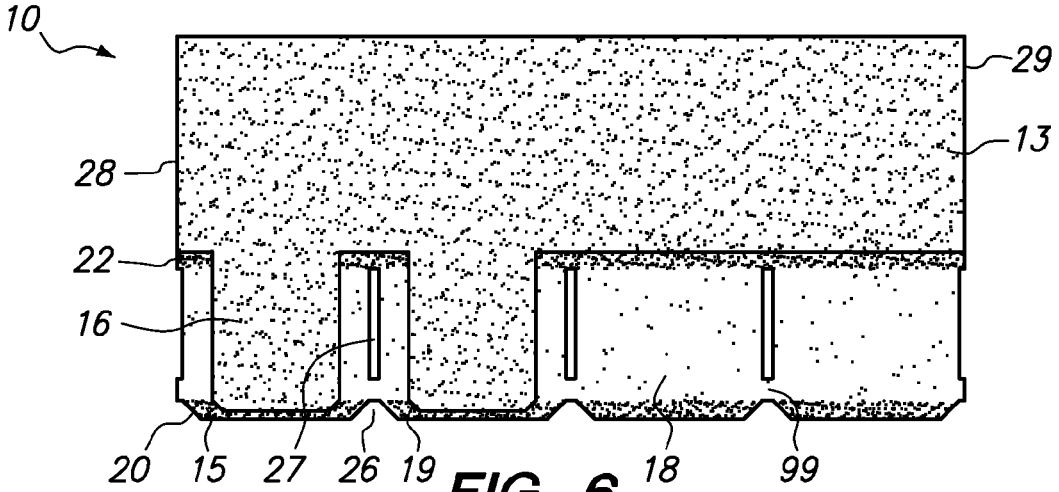
Figure 7:
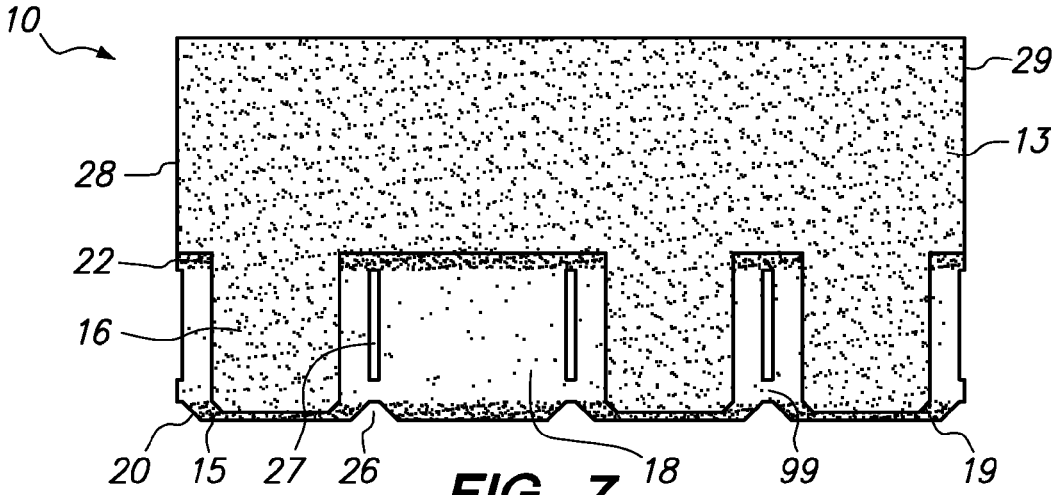
Figure 8:
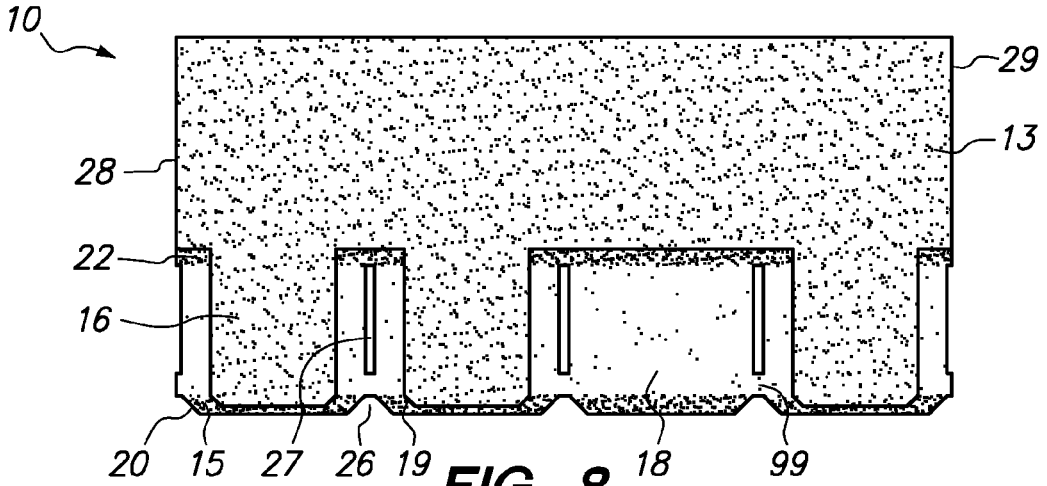
Figure 9:
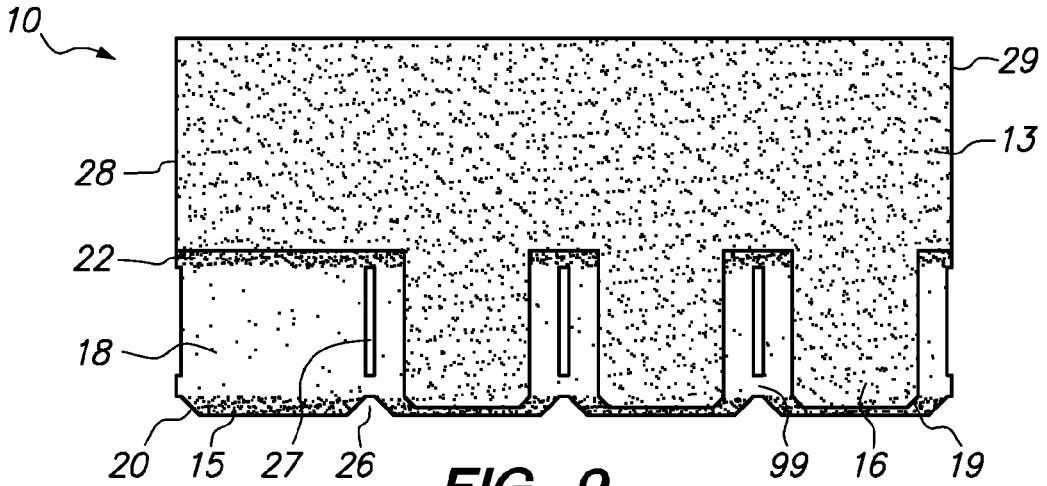
Figure 10:
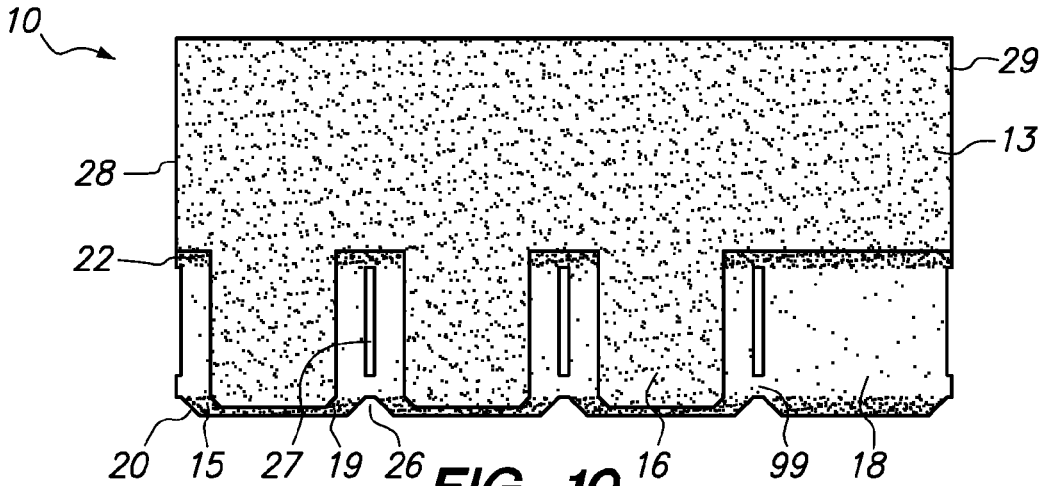
Figure 11:
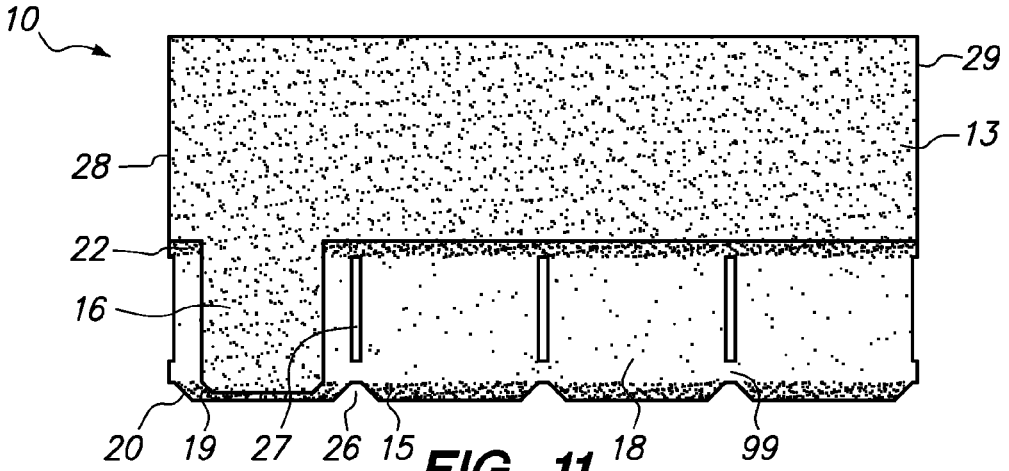
Figure 12:
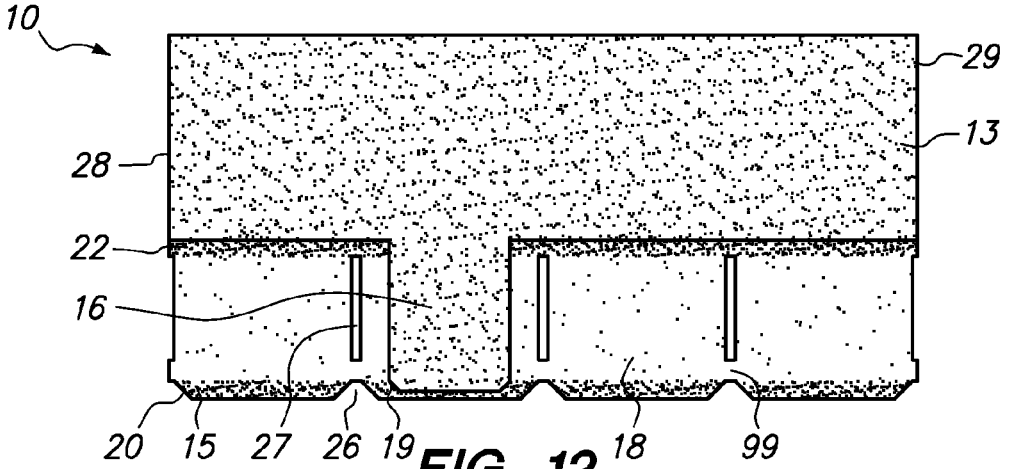
Figure 13:
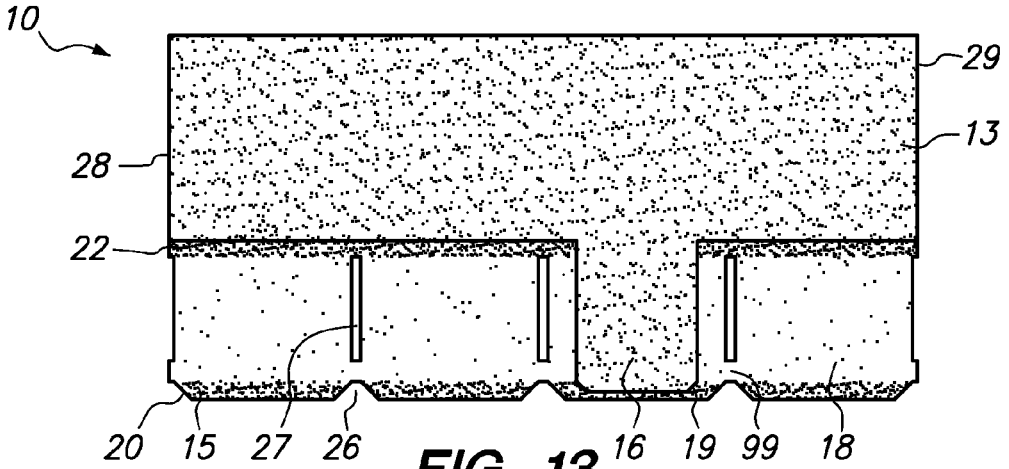
Figure 14:
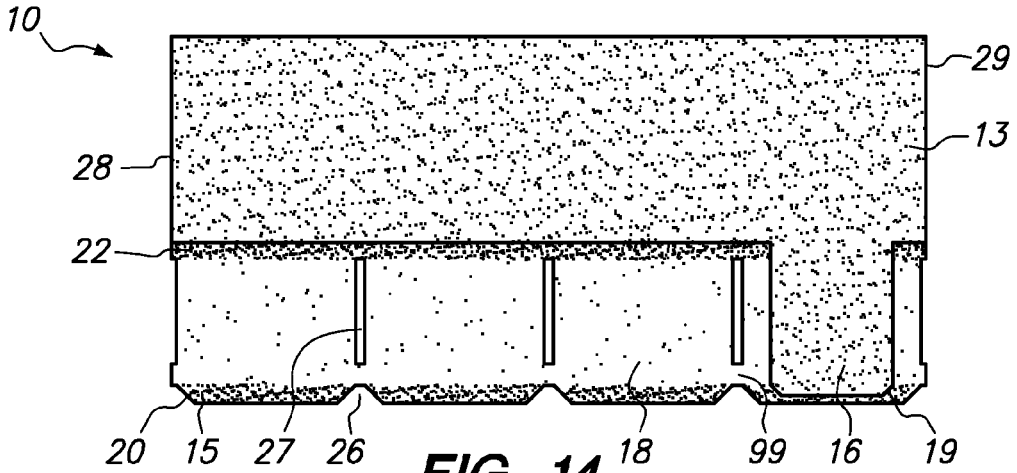

Referring to FIG. 1B, the posterior layer 12 comprises a plurality of posterior simulated tabs 18 extending from a posterior upper portion 22. The simulated tabs 18 are separated by partial slots 27. The simulated tabs 18 are connected to each other along the butt edge by connecting segments 99. In this embodiment, the posterior layer 12 comprises four posterior simulated tabs 18. The posterior simulated tabs 18 are preferably surfaced with a second shade of weather resistant or colored mineral granules having a distinguishable hue or color from the first shade of the anterior tabs 16. The contrast in shade between the posterior simulated tabs 18 and the anterior tabs 16 can be accentuated by varying the consistency of the weather resistant top coating, e.g., the density and/or size of granule deposition on either of these members. It will be appreciated that a contrast in shade between any portions or regions of the inventive shingle can similarly be achieved by the methods described herein. It should be noted that the shading of the colored mineral granules is not a necessary element of the present invention and therefore any shading scheme is appropriate.

In further embodiments, connecting segments 99 may be surfaced with the second shade of weather resistant or colored mineral granules of posterior simulated tabs 18 and/or the first shade of anterior tabs 16. Alternatively, connecting segments 99 may be surfaced with a third shade of weather resistant or colored mineral granules having a distinguishable hue or color from the first shade of the anterior tabs 16 and the second shade of posterior simulated tabs 18. In yet a further embodiment, the shading on connecting segments 99 may be selected such that a connecting segment 99 visually simulates a cavity extending from partial slots 27. In other words, connecting segments 99 may be surfaced in a hue or color that will make the connecting segments 99 visually blend in with partial slots 27, thereby creating the visual appearance of continuous slots fully extending to the posterior butt edge.

Referring to FIGS. 1, 1A, and 1B, the exposed top outer surface or weather surface of shingle 10 of the invention, i.e., the posterior simulated tabs 18, anterior tabs 16, and portions of the posterior upper portion 22, may be coated with various types of mineral granules to protect the asphalt coating, to add color to shingle 10 of the invention, and to provide fire resistance. A wide range of mineral colors from white and black to various shades of red, green, brown and any combination thereof may be used on shingle 10 of the invention to provide a roof having the desired color. In some embodiments, the entire top outer surface of shingle 10 of the invention may be coated with one of the aforementioned coatings. In further embodiments, the entire top surface of anterior layer 11 may be coated with coatings that contrast with coatings applied to the entire top surface of posterior layer 12. In another embodiment, the top surface of anterior headlap 13 of shingle 10 of the invention may be coated with coatings that contrast with coatings applied to the top surface of posterior layer 12 and anterior tabs 16. In another embodiment, the top surface of anterior headlap 13 may be coated with coatings that contrast with coatings applied to the top surface of anterior tabs 16 and also contrast with coatings applied to the entire top surface of posterior layer 12. In another embodiment, the top surface of anterior headlap 13 may be coated with coatings that contrast with coatings applied to the posterior simulated tabs 18 (and optionally, the connecting segments 99) and a portion of the posterior upper portion 22 that may be exposed. The underside of shingle 10 of the invention may be coated with various inert minerals with sufficient consistency to seal the asphalt coating. These modifications may be applied to any contemplated embodiment of the invention in any combination.

The posterior layer 12 may have a width ($W_B$) of at least 7¾ inches up to 17 inches, and is preferably about 8⅜".

Partial slot 27 separating adjacent posterior simulated tabs 18 can preferably have a height $H_4$ of between about 4" and about 6", and preferably about 4 13/16", and a breadth $B_3$ of between about ¼ inch to about 1 inch, and preferably about ⅜", commensurate with the size of the posterior simulated tabs 18 and the height and size of the roofing area. The breadth $B_2$ of each posterior simulated tab 18 preferably ranges from about 7¼" to about 9¼", and is most preferably about 8¼". The height $H_2$ of each posterior simulated tab 18 ranges preferably from about 5½" to about 7½", and is most preferably about 6⅝". In a preferred embodiment, the posterior simulated tabs 18 are broader than overlying anterior tabs 16.

Connecting segments 99 may have a height $H_3$ of about ¼" to about 1¾", and is most preferably about 1.0". The breadth $B_3$ of a connecting segment 99 is commensurate with the breadth $B_3$ of the partial slot 27 above the connecting segment 99.

The butt edge of the posterior simulated tabs 18 can be curved or straight and the tab corners 20 can be cropped or can be formed by right, obtuse or acute angles. In a preferred embodiment, the posterior simulated tab corners 20 are cropped to correspond with the corners 19 of the overlying anterior tabs 16. The butt edge of the posterior simulated tabs 18 may carry a shadow tip 15 which may be painted or imprinted horizontally across the simulated tab bottom margin to provide a contrasting surface finish or texture. The shadow tip 15 may comprise granules having a fourth shade that contrasts with the first shade of the anterior tabs 16, the second shade of the posterior simulated tabs 18, and the third shade of the connecting segments. It is further contemplated that the shadow tip 15 may comprise two or more horizontal bands of different color or shade to simulate a visual blending of colors or shading.

The posterior upper portion 22, which underlies the anterior headlap 13, is only partially exposed from the front view of the composite, two-layer shingle 10. The posterior upper portion 22 may be surfaced with weather resistant or colored granules and may include a shadow band at the interface between the posterior upper portion 22 and the posterior simulated tabs 18 to simulate shadowing or depth. The shadow band may be applied to the entire posterior upper portion 22 (as illustrated in FIG. 1B) or a portion of the posterior upper portion 22 (not shown in figures). The shadow band may have a substantially unvaried width ranging from about 1½" to about 2½", preferably being about 2". In another embodiment of the present invention, the width of the shadow band may be varied to provide a perception of irregularity. The color of the shadow band can be the same as that of the shadow tip 15 of the posterior simulated tabs 18 or it can be a lighter or darker shade or hue; or the color of the shadow band can be distinctly different to simulate bulk, highlight, shadow or any other aesthetic effect achievable by contrast with the exposed areas of the posterior layer 12. In yet a further embodiment, connecting segments 99 may be covered entirely or partially by a shadow band to simulate shadowing or depth, and/or further create the illusion of a continuous slot extending from partial slot 27.

The posterior layer 12 is secured to the anterior layer 11 forming a two-layer laminated or composite shingle 10, such that a minimum width of surface contact, or common bond, (measured transversely across the composite shingle) between the underside of the anterior headlap and the upper side of the backer strip is provided. See, e.g., FIG. 21 (dimension $W_m$). The anterior layer 11 is positioned so that the anterior tabs 16 are positioned on the posterior simulated tabs 18, preferably such that the anterior tabs 16 are positioned substantially centered on the posterior simulated tabs 18, though this centering is not necessary for the invention. The anterior layer 11 may alternatively be positioned so that the anterior tabs 16 are positioned on the posterior simulated tabs 18, such that the anterior tabs 16 are offset from the posterior simulated tabs 18. In a preferred embodiment, the posterior simulated tabs 18 extend beyond the lower portion of the anterior tabs 16. In an even more preferred embodiment, the posterior simulated tabs 18 extend about ½" beyond the anterior tabs 16.

Figure 15:
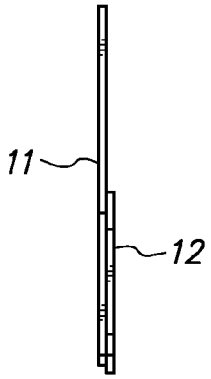
FIG. 15 shows a right side view of an exemplary embodiment of the roofing shingle of the present invention.
Figure 16:
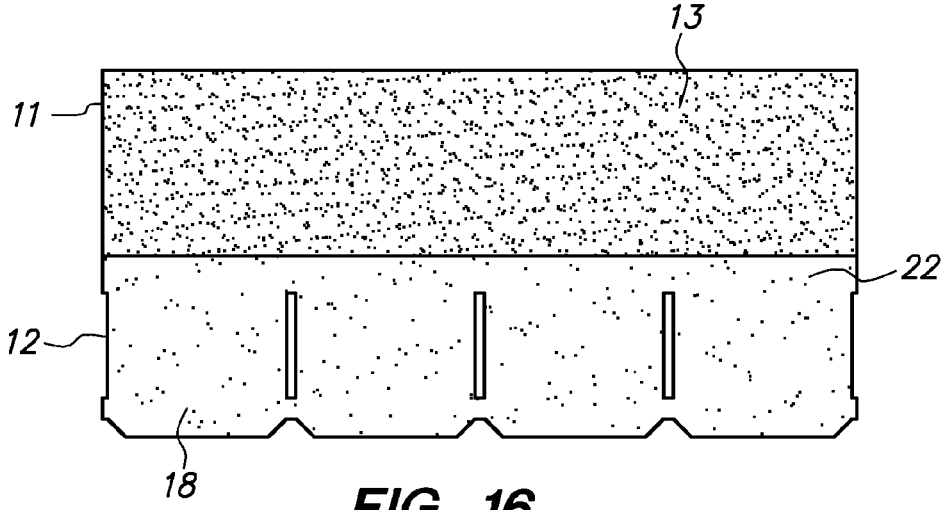
FIG. 16 shows a bottom plan view of an exemplary embodiment of the roofing shingle of the present invention.

FIG. 15, depicts a right side view of the positioning of the anterior layer 11 on the posterior layer 12.

Manufacturing of the inventive shingle embodiments is described with reference to the two-layer composite shingle. However, the two-layer composite is used only as an example and the method of manufacturing is not limited to this embodiment.

Manufacturing the two-layer composite shingle begins with applying granules to asphalt sheeting, where the granules can be blended to produce the desired shading and then applied to the surface of the asphalt sheet. The granule laden asphalt sheet is then pressed in a press roll unit, such that the granules embed in the asphalt coating. The asphalt sheet is then cut to the desired shape. The cutting process first measures out one shingle length of material and then feeds the measured amount into the cutting module. The cutting module preferably includes a rotary cutting cylinder with hardened steel tooling. The tab pattern of anterior layer 11 is cut using a fractional cutting cylinder, where the fractional cutting cylinder produces a pattern that is a fraction of the shingle length. This provides a substantially repeating pattern.

The shingles of the invention may be cut using the commonly utilized "one and a half around" cutting cylinder, which is 1.5 times the length of the shingle and produces three shingles for every two rotations. The pattern of posterior simulated tabs 18 on the posterior layer 12 may be cut at a greater frequency than the pattern of anterior tabs 16 on the anterior layer 11.

Following cutting, the posterior layer 12 and anterior layer 11 are joined. In broad terms, preferably, an adhesive is applied to the posterior layer 12 and/or anterior layer 11, wherein following the application of the adhesive the posterior layer 12 and anterior layer 11 are pressed together. The pressed posterior layer 12 and anterior layer 11 are then cut to a predetermined shingle length.

For one embodiment of the present invention, the shingle 10 may be formed from a fiberglass mat (not shown) with an asphalt coating on both sides of the mat. If desired, the present invention may also be used with shingles formed from organic felt or other types of base material, including but not limited to synthetic mats or synthetic glass/hybrid mats having an appropriate coating. Nonlimiting embodiments of coatings include asphalt and modified bituminous coatings based on atactic polypropylene (APP), styrene-butadiane-styrene (SBS), styrene-ethylene-butadiene-styrene (SEBS), amorphous polyalpha olefin (APAO), thermoplastic polyolefin (TPO), synthetic rubber or other asphaltic modifiers.

The inventive shingles are installed in overlapping courses. Installation of the inventive shingles is further described by reference to the two-layer composite embodiment as an example only. The inventive shingle installed may have an anterior layer 11 formed from a cutting cylinder having a circumference that is a fraction of the two-layer composite shingle length. Upon installation of each course, the trailing edge 29 of one shingle 10 is positioned in abutment with the leading edge 28 of the successive shingle. The courses overlap where the butt of a second course of shingles covers the headlap 13 of the preceding course of shingles, where the posterior simulated tabs 18 of the shingles of the second course are offset from those of the preceding course.

In a preferred embodiment, the posterior simulated tabs 18 of each shingle are of equal height and are formed having cut approximately 45 degree angled corners 20, where the corners of each adjacent posterior simulated tab 18 meet the edge of the connecting segment 99 disposed between said adjacent posterior simulated tabs 18 to form a substantially trapezoid shaped edge 26.

In another embodiment, the posterior layer of each shingle has corners that form a substantially right angle. The invention does not rely on the shape of the posterior corners.

Additionally, the shadow band of the posterior layer 12 of the shingles in the preceding course aligns with the shadow tip 15 at the end of the posterior simulated tabs 18 of the shingles in the succeeding course to give the appearance of the depth present in bulkier roofing.

Figure 17:
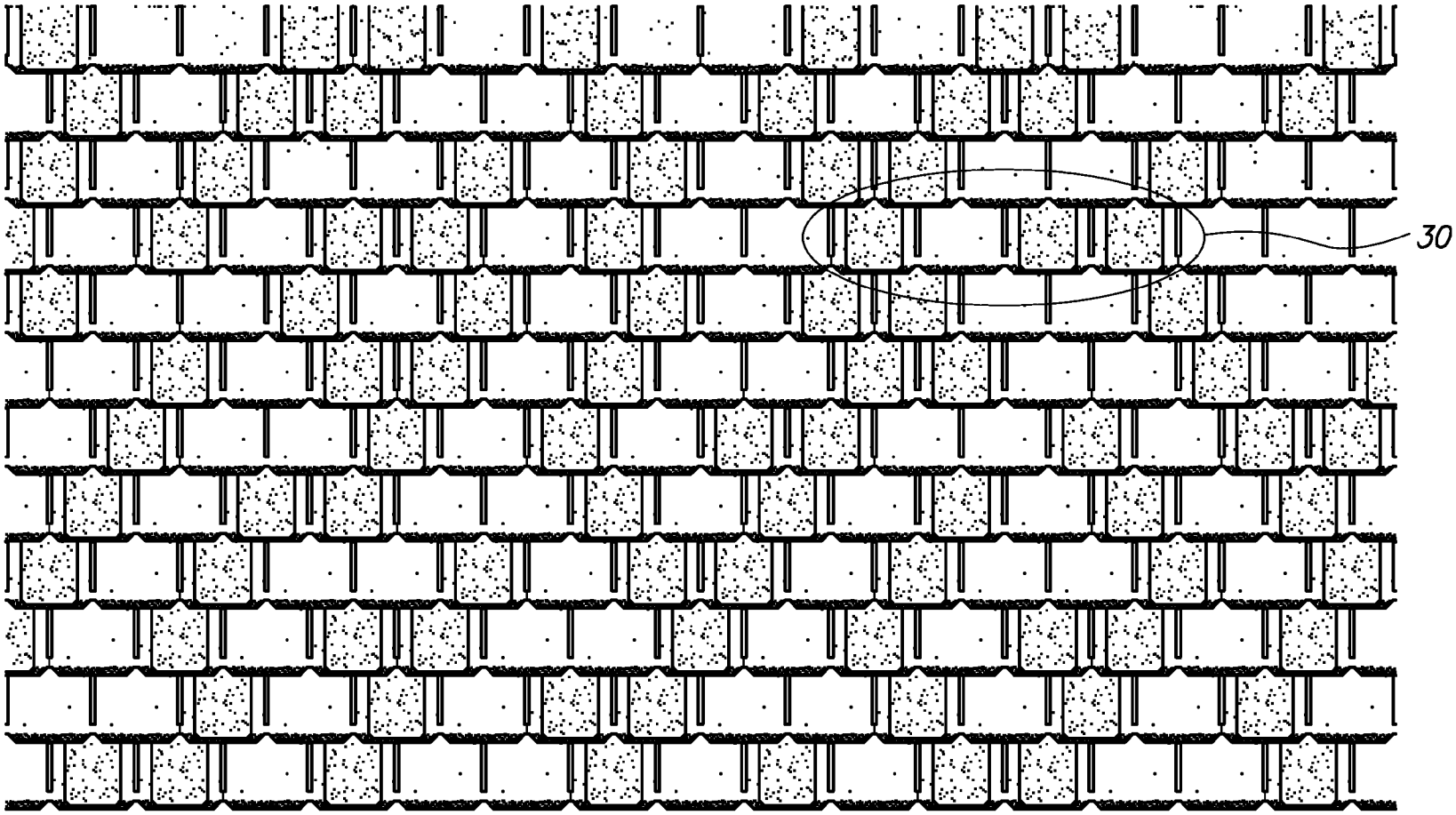
FIG. 17 shows a top plan view of an exemplary embodiment of a roofing system of the present invention incorporating the various two-layer roofing shingle embodiments of the present invention.
Figure 18:
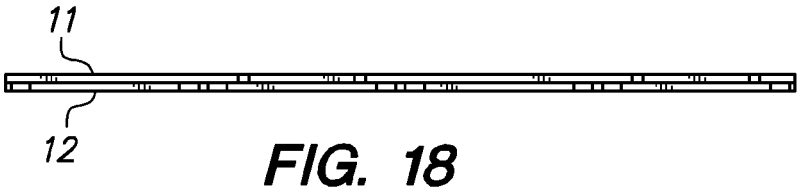
FIG. 18 shows a front elevation view of the exemplary embodiment of the roofing shingle of the present invention depicted in FIG. 1.
Figure 19:
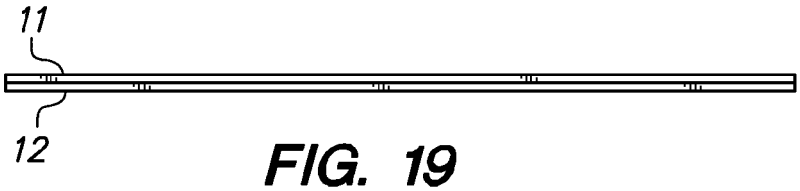
FIG. 19 shows a rear elevation view of an exemplary embodiment of the roofing shingle of the present invention.
Figure 20:
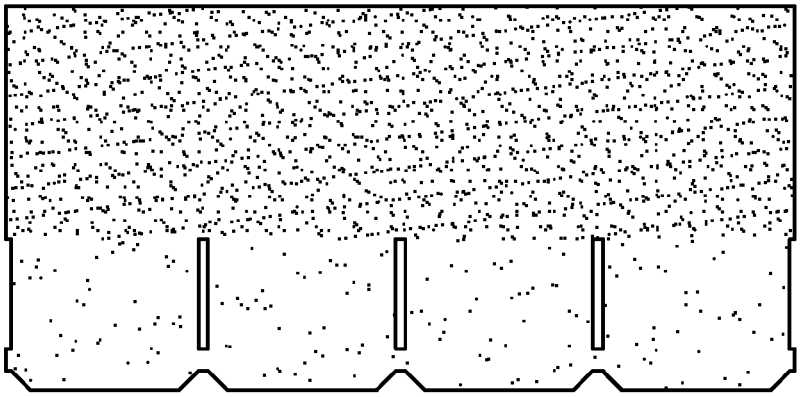
Figure 21:
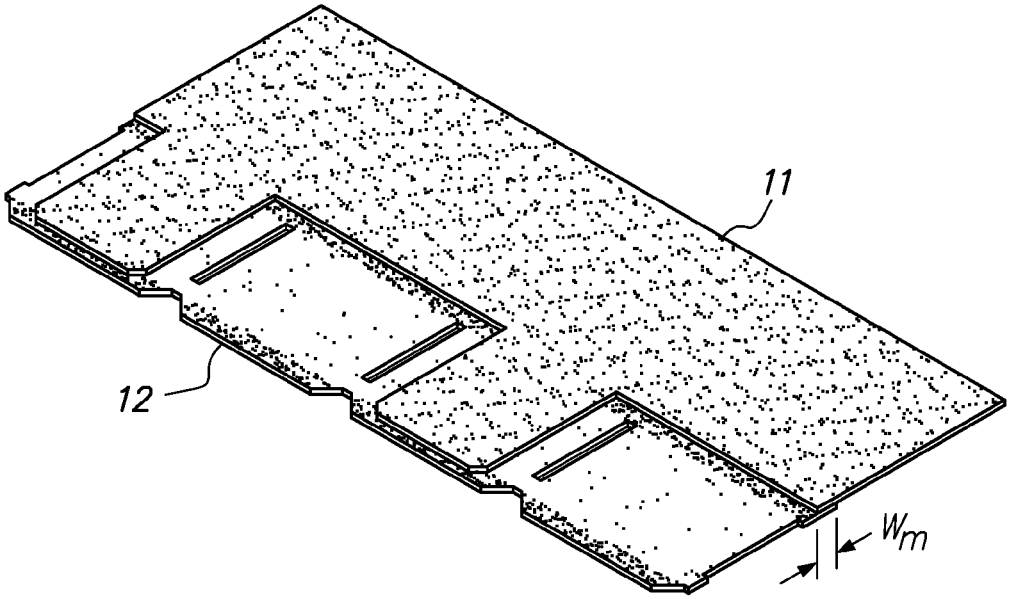
FIG. 21 shows a perspective view of the exemplary embodiment of the roofing shingle of the present invention depicted in FIG. 4, wherein a minimum width of surface contact ($W_m$) between the underside of the anterior headlap and the upper side of the backer strip is illustrated.

FIG. 17 depicts the two-layer composite shingle 30 installed upon a portion of a roof. Shingles 10 of the present invention may be deployed in a roofing system, wherein first, second, and third adjacent shingles differ from each other based on the position of at least one anterior tab 16 on a posterior simulated tab 18, and wherein the first adjacent shingle and the fourth adjacent shingle in a course are identical based on the positions of the one or more anterior tabs, so that when installed, a pattern of varying anterior tabs is created based on the location of the anterior tabs.

Shingles 10 of the present invention may further be deployed in a roofing system, wherein first, second, third, fourth, and fifth adjacent shingles differ from each other based on the position of at least one anterior tab 16 on a posterior simulated tab 18, and wherein the first adjacent shingle and the sixth adjacent shingle in a course are identical based on the positions of the one or more anterior tabs, so that when installed, a pattern of varying anterior tabs is created based on the location of the anterior tabs.

Shingles 10 of the present invention may further be deployed in a roofing system, wherein first, second, third, fourth, fifth, sixth, and seventh adjacent shingles differ from each other based on the position of at least one anterior tab 16 on a posterior simulated tab 18, and wherein the first adjacent shingle and the eighth adjacent shingle in a course are identical based on the positions of the one or more anterior tabs, so that when installed, a pattern of varying anterior tabs is created based on the location of the anterior tabs.

Not being limited to any particular theory, the aesthetically pleasing and seemingly random appearance of the installed shingles of the invention may result from the arrangement of anterior tabs and anterior openings having the same breadth, wherein the anterior openings appear to be voids where the anterior tabs should be situated. The void of the anterior tabs may create a visual illusion of missing anterior tabs, which may resemble prior art shingles that have utilized the absence of anterior tabs to create the appearance of bulk and randomness of more expensive roofing materials. The appearance of bulk is also enhanced by the presence of posterior simulated tabs 18, which in the case of two-layer shingles can provide a cavity that is up to two layers deep at the partial slots 27. The visual depth of the partial slots 27 may further be enhanced by modifying the shading of the connecting segments 99 beneath the partial slots 27, as discussed above.

Additional embodiments include single layer shingles (see FIG. 20) and shingles with three or more layers (not shown) as long as partial slots 27 are employed to simulate traditional, discrete tabs, wherein simulated tabs 18 are formed and connected by a connecting segment 99.

An important feature of the present invention includes providing a connecting segment 99. Prior art two-layer, or bilaminated, shingles with posterior tabs that are not partially covered by an anterior tab are susceptible to wind failure. In particular, the prior art single-layered tabs (i.e., posterior tabs without partial cover from anterior tabs) are susceptible to wind failure upon installation (prior to sealing) and even after the shingles have been sealed. The shingles of the invention provide increased rigidity for single-thickness simulated tabs (which resemble traditional, discrete tabs) thereby improving the shingle's wind failure resistance compared to the prior art.

The shingles of the invention are improvements of roofing shingle materials known in the art, wherein the improvements are providing roofing shingles having simulated tabs that are connected to at least one adjacent simulated tab by a connecting segment, which simulate the appearance of traditional, discrete tabs and having improved weather performance over the prior art, especially with respect to resisting wind failure.

Although the present invention and its advantages have been described in detail, it should be understood that various changes, substitutions and alterations can be made therein without departing from the spirit and scope of the invention as defined by the appended claims.

What is claimed is:

1. A two-layer laminated roofing shingle comprising:

(a) a posterior layer having a posterior upper portion and a posterior buttlap including a plurality of posterior simulated tabs extending from said posterior upper portion, said posterior simulated tabs spaced apart by a plurality of partial slots, and each of said posterior simulated tabs is connected to at least one adjacent posterior simulated tab by a connecting segment;

(b) an anterior layer having an anterior headlap and an anterior buttlap including one or more anterior tabs extending from said anterior headlap;

wherein the anterior layer is positioned on the posterior layer in a manner such that each anterior tab is positioned on one of the posterior simulated tabs;

wherein at least one of the posterior simulated tabs serves as a single-layer simulated tab of the roofing shingle;

wherein the anterior layer is free of alignment notches positioned on a lower edge of the anterior headlap; and wherein at least a portion of the posterior upper portion is positioned under the anterior headlap.

2. A two-layer laminated roofing shingle comprising:

(a) a posterior layer having a posterior upper portion and a posterior buttlap including four posterior simulated tabs extending from said posterior upper portion, said posterior simulated tabs spaced apart by a plurality of partial slots, and each of said posterior simulated tabs is connected to at least one adjacent posterior simulated tab by a connecting segment, and wherein each posterior simulated tab has a posterior simulated tab corner;

(b) an anterior layer having an anterior headlap, one or more anterior tabs extending therefrom;

wherein the anterior layer is positioned on the posterior layer in a manner such that each anterior tab is positioned on one of the posterior simulated tabs;

wherein at least a portion of the posterior upper portion is positioned under the anterior headlap; and wherein the posterior simulated tabs are surfaced with a first shade of granules and the connecting segments are surfaced with a second shade of granules that is darker than said first shade of granules.

3. The roofing shingle according to claim 1 or 2, wherein the connecting segment is located at or near a lower edge of the posterior buttlap.

4. The roofing shingle according to claim 3, wherein the connecting segment has a height of about 1 inch.

5. The roofing shingle according to claim 1 or 2, wherein the portion of the posterior upper portion is positioned under the anterior headlap defines a minimum width of surface contact.

6. The roofing shingle according to claim 5, wherein the minimum width of surface contact is about ⅞ inches.

7. The roofing shingle according to claim 1, wherein the posterior simulated tabs are surfaced with a first shade of granules and the connecting segments are surfaced with a second shade of granules that is darker than said first shade of granules.

8. A roofing system comprising a plurality of courses of shingles according to claim 1 or 2, wherein the shingles are installed on a roof deck in overlapping courses.

9. A roofing system comprising a plurality of courses of shingles according to claim 2, wherein the shingles are installed on a roof deck in overlapping courses, wherein first, second, and third adjacent shingles differ from each other based on the position of at least one anterior tab, and wherein the first adjacent shingle and the fourth adjacent shingle in a course are identical based on the positions of the one or more anterior tabs, so that when installed, a pattern of varying anterior tabs is created based on the locations of the anterior tabs.

10. A roofing system comprising a plurality of courses of shingles according to claim 2, wherein the shingles are installed on a roof deck in overlapping courses, wherein first, second, third, fourth, and fifth adjacent shingles differ from each other based on the position of at least one anterior tab, and wherein the first adjacent shingle and the sixth adjacent shingle in a course are identical based on the positions of the one or more anterior tabs, so that when installed, a pattern of varying anterior tabs is created based on the locations of the anterior tabs.

11. A roofing system comprising a plurality of courses of shingles according to claim 2, wherein the shingles are installed on a roof deck in overlapping courses, wherein first, second, third, fourth, fifth, sixth, and seventh adjacent shingles differ from each other based on the position of at least one anterior tab, and wherein the first adjacent shingle and the eighth adjacent shingle in a course are identical based on the positions of the one or more anterior tabs, so that when installed, a pattern of varying anterior tabs is created based on the locations of the anterior tabs.

12. The roofing shingle according to claim 2, wherein the anterior headlap comprises one anterior tab extending therefrom.

13. The roofing shingle according to claim 2, wherein the anterior headlap comprises two anterior tabs extending therefrom.

14. The roofing shingle according to claim 2, wherein the anterior headlap comprises three anterior tabs extending therefrom.

15. The roofing shingle according to claim 2, wherein:

the at least one anterior tab further comprises granules having the second shade;

the posterior layer further comprises a shadow band positioned at an interface between the posterior simulated tabs and the posterior upper portion;

the posterior simulated tabs further comprise a shadow tip positioned on a lower edge of the posterior simulated tabs;

the shadow tip and shadow band include granules having a third shade that is darker than said first shade of granules of the posterior simulated tabs and the second shade of granules of the at least one anterior tab and the connecting segments.

16. The roofing shingle according to claim 2, wherein the at least one anterior tab has a first breadth and the posterior simulated tabs have a second breadth, and wherein the second breadth is greater than the first breadth.

17. The roofing shingle according to claim 2, wherein the posterior simulated tabs are separated by partial slots having a breadth of from about ¼" to about 1 inch.

18. The roofing shingle according to claim 1 or 2, wherein each of the at least one anterior tabs is positioned substantially over the center of one of the posterior simulated tabs.

19. A roofing system comprising a plurality of courses of shingles according to claim 2, wherein the shingles are installed on a roof deck in overlapping courses, and wherein the anterior headlap of a previously installed shingle is visible through the partial slots of a subsequently installed shingle such that the second shade of granules on the connecting segments of the subsequently installed shingle visually blend in with the partial slots of the subsequently installed shingle to create a visual appearance of continuous slots fully extending to a posterior butt edge of the subsequently installed shingle.

20. The roofing shingle according to claim 2, wherein the anterior tabs are surfaced with a third shade of granules having a distinguishable hue or color from the first shade of granules on the posterior simulated tabs and the second shade of granules on the connecting segments.

* * * * *